US009905218B2

(12) United States Patent
Reaves et al.

(10) Patent No.: US 9,905,218 B2
(45) Date of Patent: Feb. 27, 2018

(54) METHOD AND APPARATUS FOR EXEMPLARY DIPHONE SYNTHESIZER

(71) Applicant: SPEECH MORPHING SYSTEMS, INC., San Jose, CA (US)

(72) Inventors: Benjamin Reaves, Menlo Park, CA (US); Steve Pearson, San Jose, CA (US); Fathy Yassa, Soquel, CA (US)

(73) Assignee: SPEECH MORPHING SYSTEMS, INC., San Jose, CA (US)

( * ) Notice: Subject to any disclaimer, the term of this patent is extended or adjusted under 35 U.S.C. 154(b) by 0 days.

(21) Appl. No.: 14/256,917

(22) Filed: Apr. 18, 2014

(65) Prior Publication Data

US 2017/0162188 A1 Jun. 8, 2017

(51) Int. Cl.

| | |
|---|---|
| ***G10L 13/06*** | (2013.01) |
| ***G10L 13/07*** | (2013.01) |
| ***G10L 13/033*** | (2013.01) |
| *G10L 25/90* | (2013.01) |
| *G10L 13/04* | (2013.01) |

(52) U.S. Cl.

CPC ..... *G10L 13/07* (2013.01); *G10L 13/033* (2013.01); *G10L 13/0335* (2013.01); *G10L 13/04* (2013.01); *G10L 25/90* (2013.01)

(58) Field of Classification Search

CPC ..... G10L 13/04; G10L 2021/0135; G10L 13/033; G10L 13/047; G10L 13/06; G10L 13/08; G10L 21/00; G10L 21/003; G10L 25/15

USPC ... 704/258, 260, 2, 200, 203, 216, 269, 272, 704/267, 211, 268, 205, 270, 256, 245, 704/261, 255, 256.4

See application file for complete search history.

(56) References Cited

U.S. PATENT DOCUMENTS

| | | | | |
|---|---|---|---|---|
| 5,327,521 | A * | 7/1994 | Savic | G10L 21/00 704/200 |
| 7,953,600 | B2 * | 5/2011 | Hertz | G10L 13/033 704/258 |
| 8,594,993 | B2 * | 11/2013 | Qian | G10L 21/003 704/2 |
| 2002/0193994 | A1 * | 12/2002 | Kibre | G10L 13/047 704/260 |
| 2003/0212555 | A1 * | 11/2003 | van Santen | G10L 13/04 704/241 |
| 2004/0030555 | A1 * | 2/2004 | van Santen | G10L 13/08 704/260 |
| 2004/0111266 | A1 * | 6/2004 | Coorman | G10L 13/07 704/260 |
| 2005/0131679 | A1 * | 6/2005 | Gigi | G10L 25/00 704/205 |
| 2012/0072224 | A1 * | 3/2012 | Khitrov | G10L 13/08 704/260 |

* cited by examiner

*Primary Examiner* — Vijay B Chawan
(74) *Attorney, Agent, or Firm* — Sughrue Mion, PLLC

(57) ABSTRACT

Method and apparatus for diphone or concatenative synthesis to compensate for insufficient or missing diphones.

7 Claims, 7 Drawing Sheets

Fig.1 – block diagram of concatenator

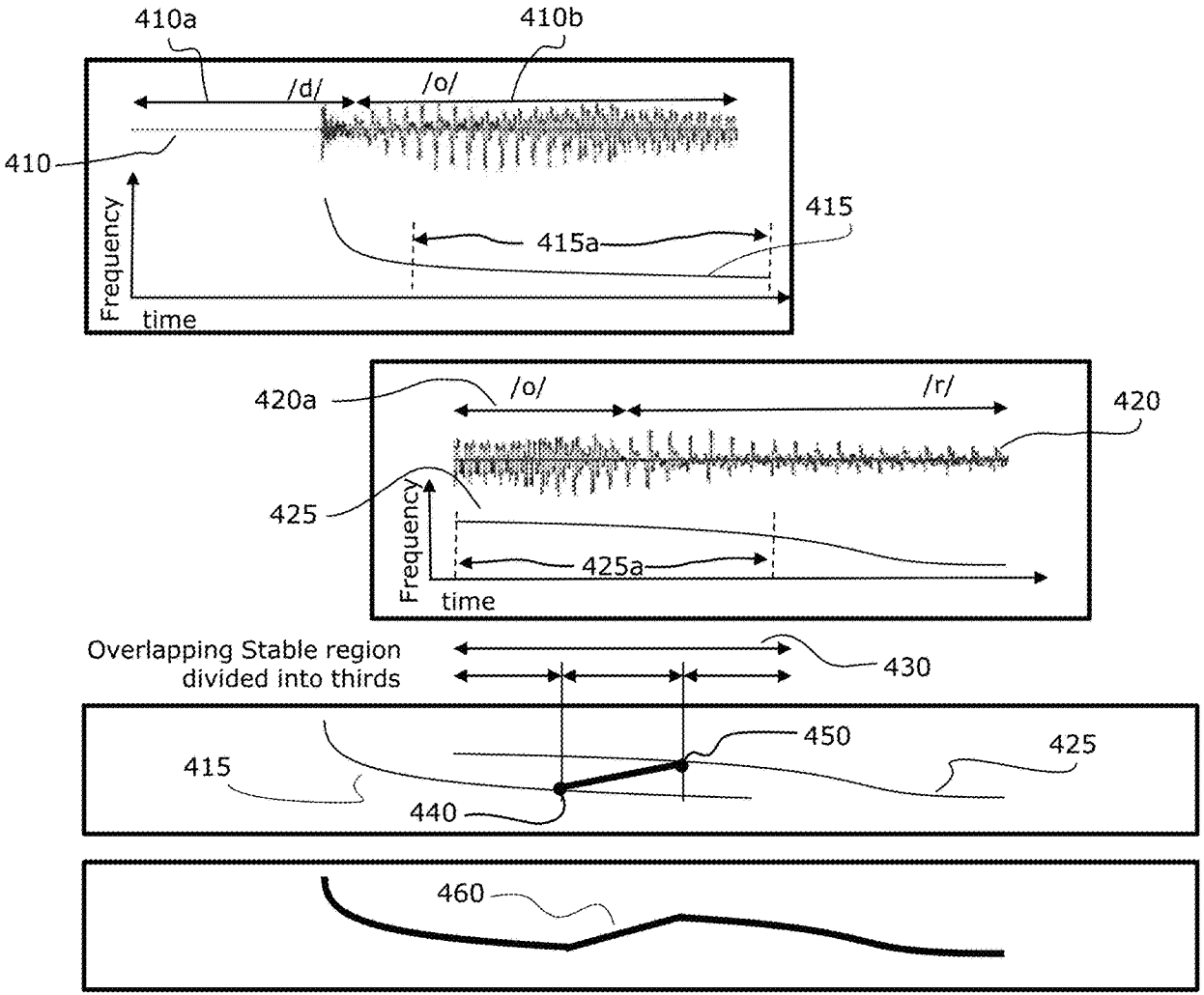
Fig.4 – good match (normal case)

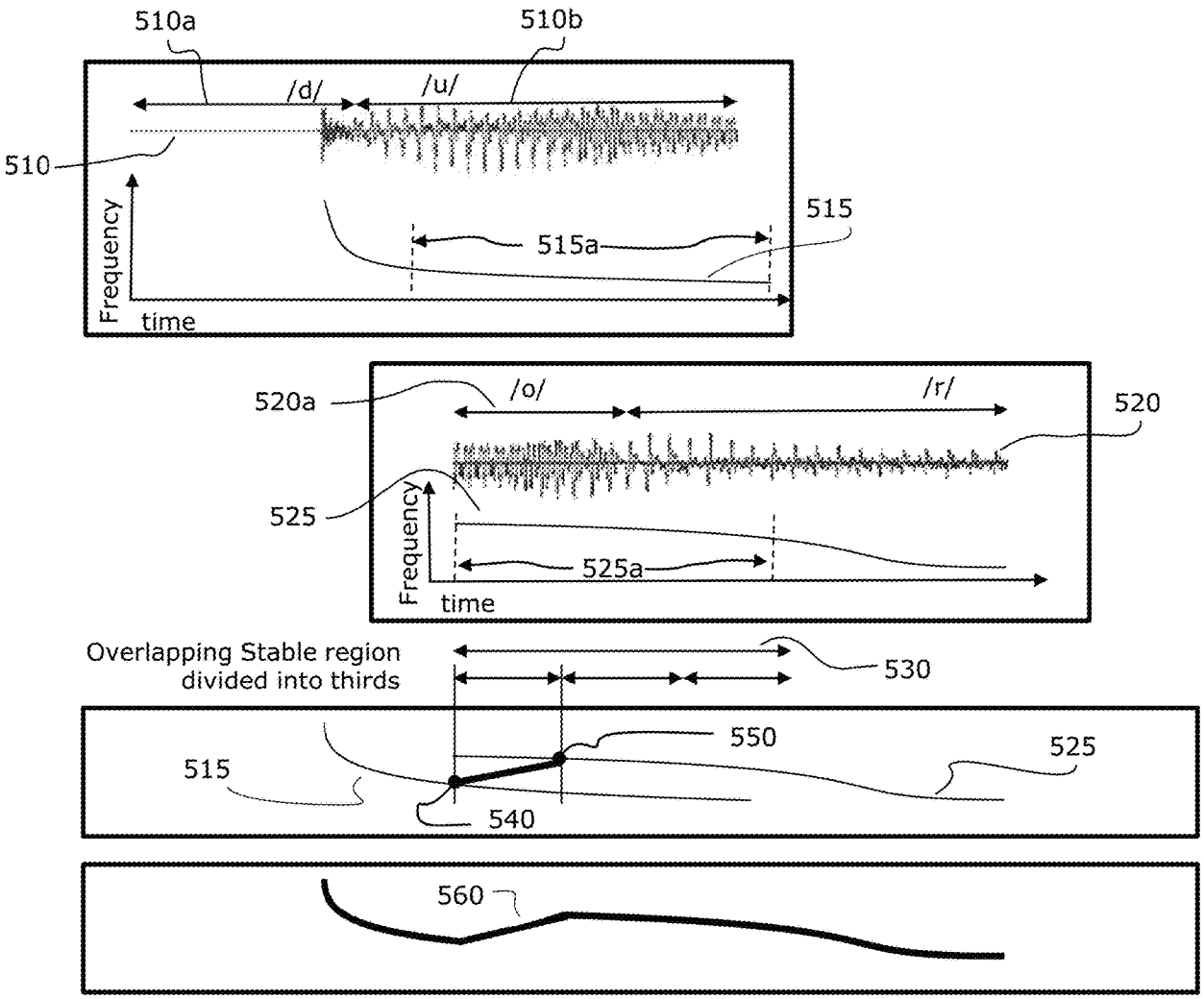
Fig.5 – bad match of first diphone

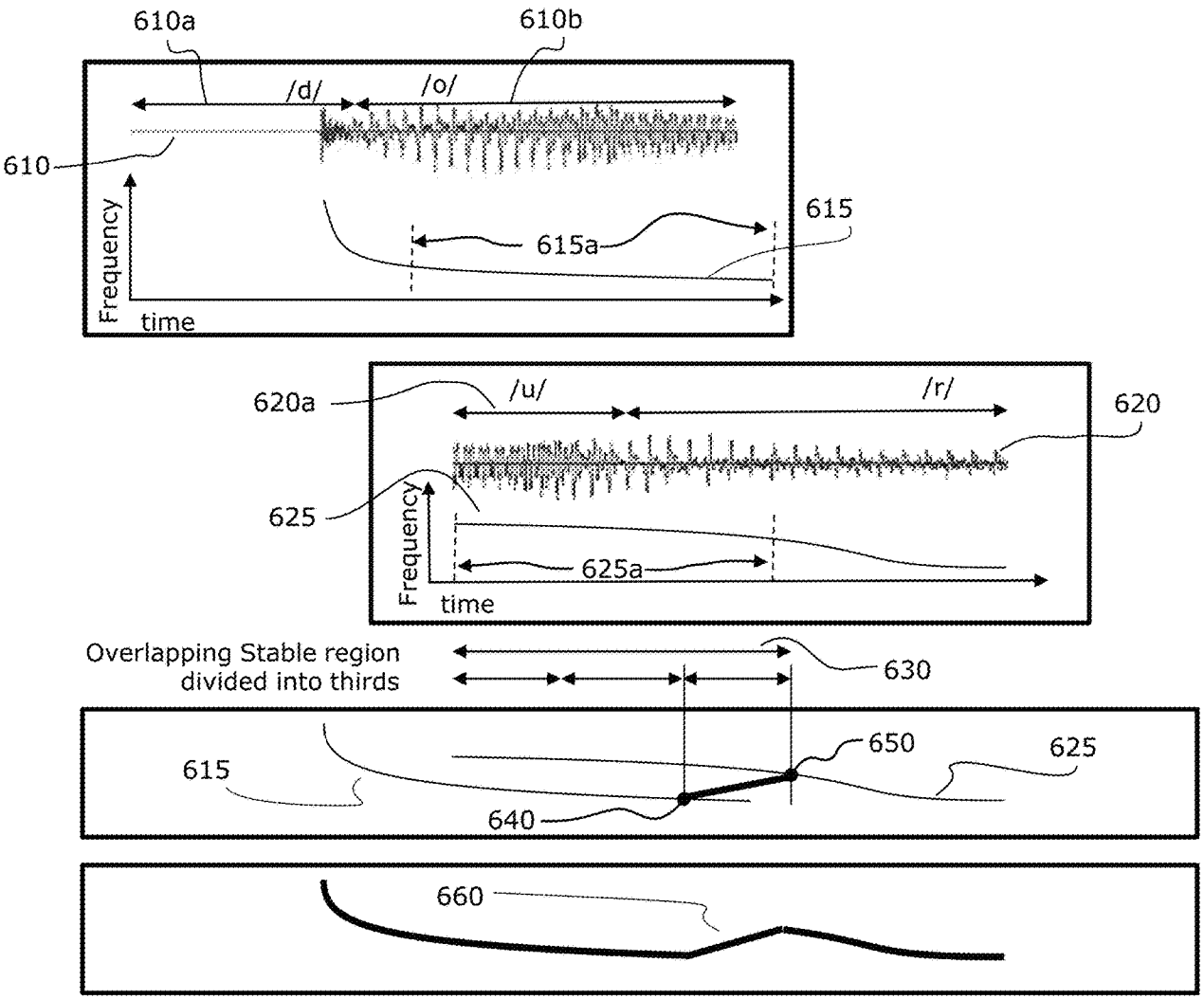
Fig.6 – bad match of second diphone

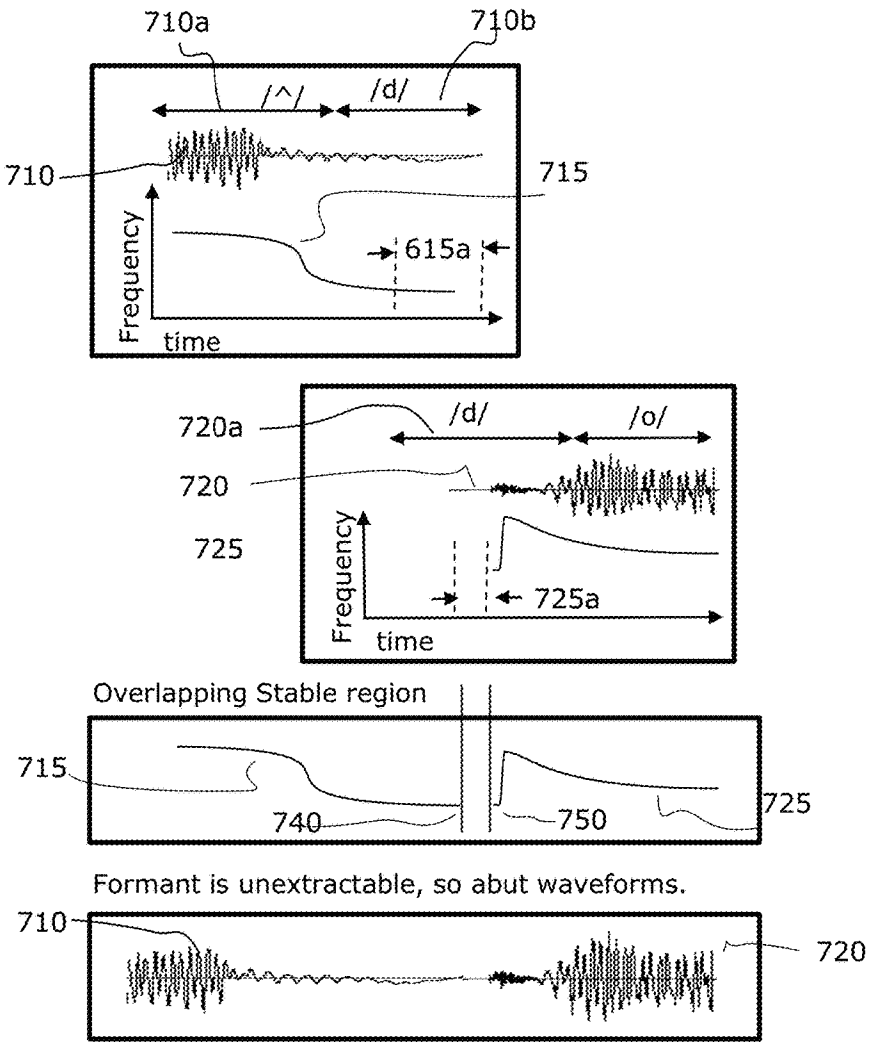
Fig.7 – morphing on a consonant

METHOD AND APPARATUS FOR EXEMPLARY DIPHONE SYNTHESIZER

BACKGROUND

Diphone synthesis is one of the most popular methods used for creating a synthetic voice from recordings or samples of a particular person; it can capture a good deal of the acoustic quality of an individual, within some limits. The rationale for using a diphone, which is two adjacent half-phones, is that the "center" of a phonetic realization is the most stable region, whereas the transition from one "segment" to another contains the most interesting phenomena, and thus the hardest to model. The diphone, then, cuts the units at the points of relative stability, rather than at the volatile phone-phone transition, where so-called coarticulatory effects appear.

The invention herein disclosed presents an exemplary method and apparatus for diphone or concatenative synthesis when the computer system has insufficient or missing diphones.

DESCRIPTION OF THE DRAWINGS

FIG. 4 represents a waveform.
FIG. 5 represents a waveform.
FIG. 6 represents a waveform.
FIG. 7 represents a waveform

DETAILED DESCRIPTION OF THE EMBODIMENTS

Figure 1:
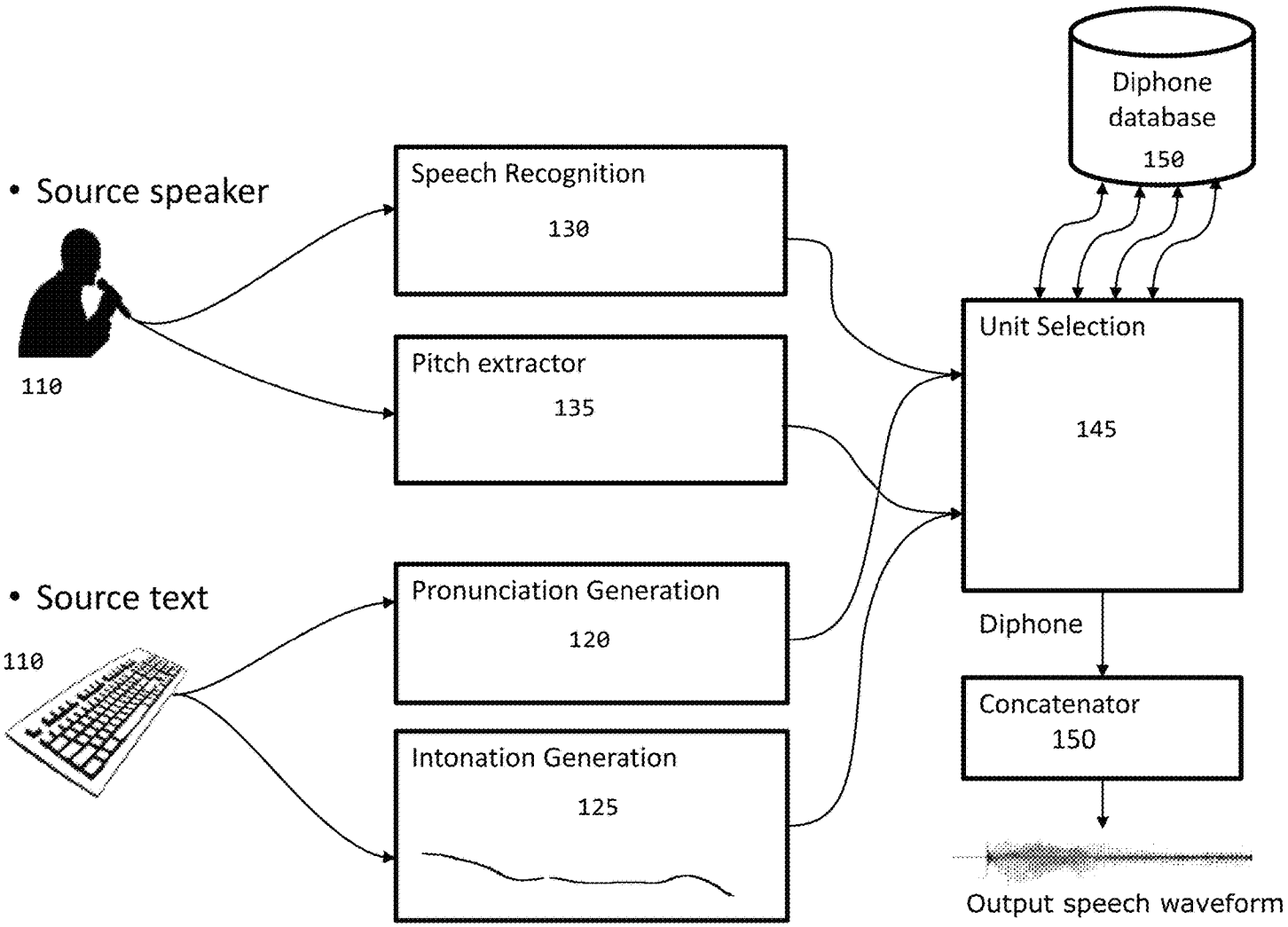
FIG. 1 represents a system level overview.

FIG. 1 illustrates a system level overview of one embodiment of the exemplary computer system, comprising one or modules, i.e. computer components, configured to convert audio speech or text into output audio replicating a desired or target voice. In one embodiment of the invention, Source 110 is audible speech. ASR 130 creates a phoneme list from Source 110's speech and Pitch Extractor 135 extracts the pitch from Source 110's speech.

In another embodiment of the invention, Source 110 is text with optional phonetic information. Phonetic Generator 120 is configured to convert the written text into the phonetic alphabet. Intonation Generator 125 is configured to generate pitch from the typed text and optional phonetic information. Together Phonetic Generator 120 and Intonation Generator 125 output a list of diphones corresponding to Source 110.

In each embodiment of the invention, Unit Selector 145 selects the best diphone ("hereinafter the selected diphone(s)") from Diphone Database 150 which most closely matches the corresponding original diphone from Phonetic Generator 120 and Intonation Generator 125.

Natural sounding speech is created by Concatenator 160, by obtaining the diphones from Unit Selector 145 and concatenating them such that abrupt and unnatural transitions are minimized.

Although the invention admits the use of diphones in this disclosure, the invention is not limited in its use to diphones. Any unit of speech can be used.

Figure 2:
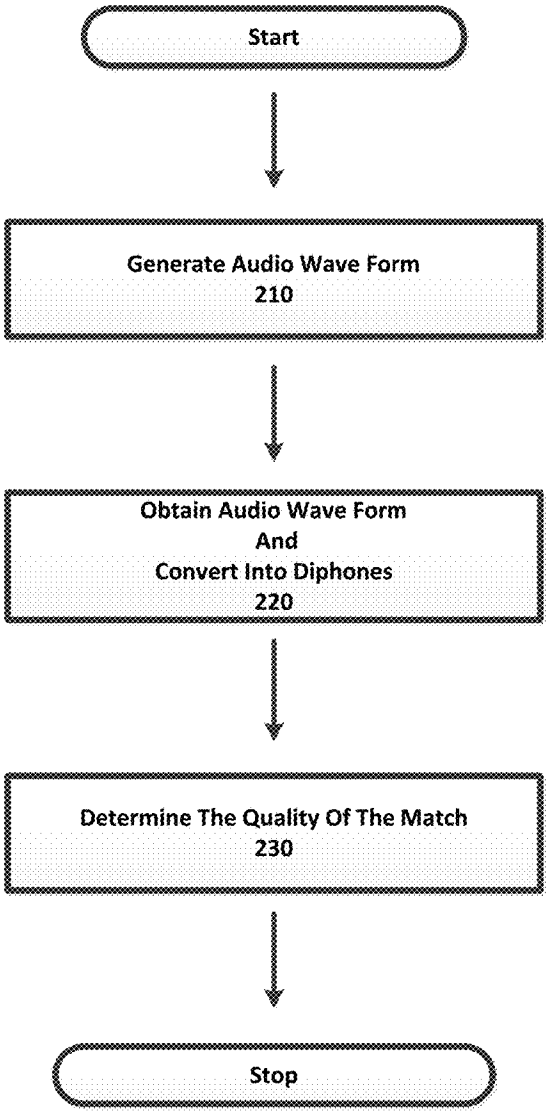
FIG. 2 represents a flow diagram.

FIG. 2 illustrates a flow diagram of one embodiment of the invention. At step 210, Source 110 generates an audio waveform. Source 110 may be a live speaker, pre-recorded audio, etc. At step 220, the audio waveform is obtained by both Speech Recognizer 130 and Pitch Extractor 135. Working in tandem, at step 220, they further convert the audio waveform into a sequence of diphones representing Source 110's speech. The process of converting the audio waveform into a sequence of diphones is well known to one skilled in the art of speech morphology.

In a second embodiment of the invention Source 110 is written text with or without phonetic descriptors. At alternative step 210, said text is obtained by Pronunciation Generator 120 and Intonation Generator 125, where Generator 120 and Intonation Generator 125 create a sequence of diphones representing said text.

At step 220, Unit Selector 145 determines which diphones from Diphone Database 150, i.e. the selected diphones, are the best matches to original diphones.

At step 230, Concatenator 160 combines the diphones into natural sounding speech.

Figure 3:
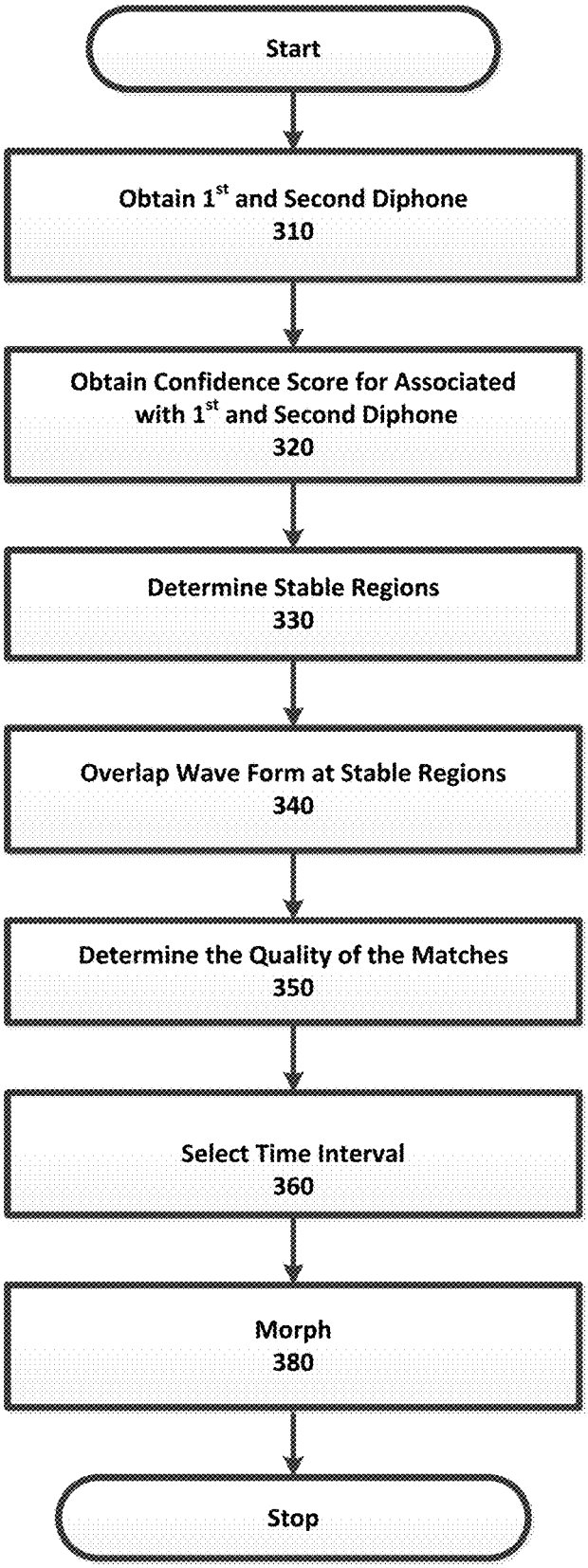
FIG. 3 represents a flow diagram.

FIG. 3 illustrates a flow diagram of Concatenator 160 concatenating the selected diphones into natural sounding speech. At step 310, Concatenator 160, obtains a first and second target diphone, each being temporally adjacent to each other, from the output of Unit Selector 145. At step 320, Concatenator 160 obtains, from Unit Selector 145, the confidence score for said first and second target diphone. The confidence score represents the quality of the match with the original text or speech, and the target diphone that was ultimately selected. For purpose of this disclosure, the confidence score is normalized to be between "0" and "1", where lower is better, i.e. where the confidence score represents the "distance" between the original diphone and the target diphone.

At step 330, Concatenator 160 determines the stable regions of the first and second target diphones. The stable region is the portion of the waveform where the frequency is relatively uniform, i.e. there are few, if any, abrupt transitions. This tends to be the vowels portion of a diphone.

At Step 340, Concatenator 160 overlaps the waveforms of said first and second target diphones to provide a region to transition from the said first target diphone to the second target diphone while minimizing abrupt transitions. Overlapping waveforms is known to one skilled in the art of speech morphology.

At step 350, Concatenator 160 determines the quality of the match between the first and second target diphone collectively, with said first and second original diphone.

Each target diphone has an associated confidence score which represents the quality of the match between said target diphone and the corresponding original diphone. Should the confidence scores for said first target diphone and said second target diphone be 0.5 or lower, Concatenator 160 considers the diphone pair to be a good match, i.e. an easy concatenation. Should the confidence score for said first or second target diphone be above 0.5, Concatenator 160 considers said diphone pair to be a low quality match with the original first and second diphones.

At step 360, the Concatenator selects the time interval, i.e. a commencement location on the first target diphone and termination location on the second target diphone, in which to combine the first and second target diphones i.e. morph the two distinct diphones into natural sounding speech.

At step 370, Concatenator 160 morphs the first and second selected diphones.

FIG. 4 is a graphical representation of synthesizing the word "door" having selecting a first and second target diphone from Diphone Database 150, said first and second target diphone having low confidence scores, i.e. good matches with the first and second original diphones and concatenating said first and second target diphone. Waveform 410 represents the waveform of the first target diphone /do/. Region 410*a* represents the /d/ portion of Waveform 410 and Region 410*b* represents the /o/ portion of Waveform 410.

For simplicity, although Waveform 410 is decomposed into its excitation function and filter function, Waveform 415 represents only the second formant of Waveform 420. Region 415*a* represents the stable region of Waveform 415.

Waveform 420 represents the waveform of the second diphone /or/. Region 420*a* represents the waveform of the /o/ portion of Waveform 420 and Region 420*b* represents the /r/ portion.

For simplicity, although Waveform 420 is decomposed into its excitation function and filter function, Waveform 425 only represents the second formant of Waveform 410. Region 425*a* represents the stable region of Waveform 425.

Region 430 represents the overlap of the stable regions between Waveform 415 and Waveform 425. This is the area where the morphing, or concatenation, occurs. Time index 440 represents the beginning of the first third of Region 425*a*, i.e. the overlapping stable area on Waveform 415 and Waveform 425. Time index 450 represents the end of the second third of Region 425*a*, i.e. the overlapping stable area on Waveform 415 and Waveform 425.

Region 460 represents the new morphed region between Diphone 410*a*, Diphone 410*b*, Diphone 420*a* and Diphone 420*b*, i.e. the /do/ and /or/ selected from Diphone Database 150.

FIG. 5 is a graphical representation of synthesizing the word "door" having selecting a first and second target diphone from Diphone Database 150, said first diphone has a high confidence score, i.e. a reasonable but not perfect match obtaining /du/ instead of /do/, and second diphone having low confidence scores, i.e. good matches with the original diphones and concatenating said first and second selected diphone. Waveform 510 represents the waveform of the first selected diphone /du/. Region 510*a* represents the /d/ portion of Waveform 510 and Region 510*b* represents the /u/ portion of Waveform 510.

For simplicity, although Waveform 510 is decomposed into its excitation function and filter function, Waveform 515 represents the second format of Waveform 510. Region 515*a* represents the stable region of Waveform 515.

Waveform 520 represents the waveform of the second diphone /or/. Region 520*a* represents the waveform of the /o/ portion of Waveform 520 and Region 520*b* represents the /r/ portion.

For simplicity, although Waveform 520 is decomposed into its excitation function and filter function, Waveform 525 represents the second formant of Waveform 520. Region 525*a* represents the stable region of Waveform 525.

Waveform 530 represents the overlap of the stable regions between Waveform 515 and Waveform 525. This is the area where the morphing, or concatenation, occurs. Time index 540 represents the beginning of Region 525*a*, i.e. the overlapping stable area on Waveform 515 and Waveform 525. Time index 550 represents the end of the second third of Region 525*a*, i.e. the overlapping stable area on Waveform 515 and Waveform 525.

Unlike Time Index 440, Time Index 550 occurs at the beginning of the stable region. Specifically, since Region 510*b* is not identical to the /o/ or /do/, Concatenator 160 diminishes the contribution of Region 510*b*.

Region 560 represents the new morphed region between Diphone 510*a*, Diphone 510*b*, Diphone 520*a* and Diphone 520*b*, i.e. the /du/ and /or/ selected from Diphone Database 150.

FIG. 6 is a graphical representation of synthesizing the word "door" having selecting a first and second diphone from Diphone Database 150, said first having a low confidence scores, i.e. a good matches with the original diphone, and said second diphone having a high confidence score, i.e. a poor matches with the original diphone, and concatenating said first and second diphones. Waveform 610 represents the waveform of the first selected diphone /do/. Region 610*a* represents the /d/ portion of Waveform 610 and Region 610*b* represents the /o/ portion of Waveform 610.

For simplicity, although Waveform 610 is decomposed into its excitation function and filter function, Waveform 615 represents the second formant of Waveform 610. Region 615*a* represents the stable region of Waveform 615.

Waveform 620 represents the waveform of the second diphone /ur/. Region 620*a* represents the waveform of the /u/ portion of Waveform 620 and Region 620*b* represents the /r/ portion.

For simplicity, although Waveform 620 is decomposed into its excitation function and filter function, Waveform 625 represents the second format of Waveform 620. Region 625*a* represents the stable region of Waveform 625.

Waveform 630 represents the overlap of the stable regions between Waveform 615 and Waveform 625. This is the area where the morphing, or concatenation, occurs. Time index 640 represents the beginning of the second third of Region 625*a*, i.e. the overlapping stable area on Waveform 615 and Waveform 625. Time index 650 represents the end of Region 625*a*.

Unlike Time Index 450 in FIG. 5, in FIG. 6, Concatenator 160 chooses the beginning of the stable region. Specifically, Region 520*a* is not identical to the /o/ or /or/, Concatenator 160 diminishes the contribution of Region 520*a*.

Region 660 represents the new morphed region between Diphone 610*a*, Diphone 610*b*, Diphone 620*a* and Diphone 620*b*, i.e. the /do/ and /ur/ selected from Diphone Database 150.

FIG. 7 illustrates a graphical diagram where the first target diphone is a vowel-consonant and the second target diphone is a consonant-vowel. Concatenator 160 concatenates at the largest stable area present.

I claim:

1. A system for converting audio speech into a target voice via diphone synthesis, the system comprising:

a database storing a plurality of diphones;

an automated speech recognizer (ASR) configured to obtain a phoneme list from an audio waveform of input speech;

a pitch extractor configured to extract pitch from the audio waveform of the input speech, wherein the ASR and the pitch extractor are configured to convert the audio waveform into a sequence of diphones based on the phoneme list and the pitch;

a unit selector configured to select from the plurality of diphones in the database a first matching diphone that best matches a first diphone in the sequence of diphones and a second matching diphone that best matches a second diphone in the sequence of diphones that is subsequent to the first diphone in the sequence of diphones; and a concatenator configured to obtain from the unit selector a first quality of a first match between the first diphone and the first matching diphone and a second quality of a second match between the second diphone and the second matching diphone, determine a first stable region of frequency of a first waveform of the first matching diphone and a second stable region of frequency of a second waveform of the second matching diphone, determine a time interval of overlap between the first stable region of the first waveform and the second stable region of the second waveform based on the first quality and the second quality, and morph the first waveform and the second waveform into output speech at the time interval.

2. The system of claim 1, wherein the concatenator is further configured to morph the first waveform of the first matching diphone and the second waveform of the second matching diphone over a middle third of the time interval of overlap.

3. The system of claim 1, wherein the concatenator is further configured to morph the first waveform of the first matching diphone and the second waveform of the second matching diphone over a first third of the time interval of overlap.

4. The system of claim 1, wherein the concatenator is further configured to morph the first waveform of the first matching diphone and the second waveform of the second matching diphone over a last third of the time interval of overlap.

5. The system of claim 1, wherein the first waveform of the first matching diphone is a second formant of a waveform of the first matching diphone decomposed into an excitation function and a filter function thereof, and wherein the second waveform of the second matching diphone is a second formant of a waveform of the second matching diphone decomposed into an excitation function and a filter function thereof.

6. The system of claim 1, wherein the concatenator is further configured to select a beginning of the first stable region as a beginning of the time interval of overlap based on the second quality indicating that second matching diphone does not match the second diphone.

7. The system of claim 1, wherein the concatenator is further configured to determine the time interval to minimize contribution of the first waveform to the output speech if the first quality indicates that the first diphone does not match the first matching diphone and contribution of the second waveform to the output speech if the second quality indicates that the second diphone does not match the second matching diphone.

* * * * *